US009631828B2

(12) United States Patent
Zhong et al.

(10) Patent No.: US 9,631,828 B2
(45) Date of Patent: Apr. 25, 2017

(54) VENTILATING FAN

(71) Applicants: Panasonic Ecology Systems Guangdong Co., Ltd., Foshan, Guangdong (CN); Panasonic Corporation, Osaka (JP)

(72) Inventors: Bodong Zhong, Guangdong (CN); Min Long, Guangdong (CN); Jiahan Hong, Guangdong (CN); Shi Zhen, Guangdong (CN); Shouyong Gao, Guangdong (CN); Hideki Hayashi, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 515 days.

(21) Appl. No.: 13/683,039

(22) Filed: Nov. 21, 2012

(65) Prior Publication Data

US 2013/0137361 A1 May 30, 2013

(30) Foreign Application Priority Data

Nov. 28, 2011 (CN) ..... 2011 2 0482626 U

(51) Int. Cl.
*F24F 7/06* (2006.01)
*F24F 7/00* (2006.01)

(52) U.S. Cl.
CPC ..... *F24F 7/065* (2013.01); *F24F 2007/001* (2013.01); *F24F 2221/32* (2013.01)

(58) Field of Classification Search
CPC ..... B01D 2279/60; B01D 46/0002; B01D 46/001; B01D 46/0016; B01D 46/005;
(Continued)

(56) References Cited

U.S. PATENT DOCUMENTS 1,955,088 A 4/1934 Pine
2,619,021 A 11/1952 Pfautsch
(Continued)

FOREIGN PATENT DOCUMENTS

CN 2337438 9/1999
CN 2733223 10/2005
(Continued)

OTHER PUBLICATIONS

Entire patent prosecution history of U.S. Appl. No. 13/457,666, filed Apr. 27, 2012, entitled, "Ventilating Fan," now U.S. Pat. No. 9,033,684, issued May 19, 2015.
(Continued)

*Primary Examiner* — Avinash Savani
*Assistant Examiner* — Vivek Shirsat
(74) *Attorney, Agent, or Firm* — RatnerPrestia

(57) ABSTRACT

The present invention discloses a ventilating fan mounted on a wall of an indoor side of a wind path therethrough from the indoor side to an outdoor side. The ventilating fan includes a ventilating fan hood, a filtering member, a ventilating fan body, and a ventilating fan mounting member. The filtering member is integrally formed by a frame provided with an engagement that is engaged with the ventilating fan body and a filtering screen located within the frame. The ventilating fan according to the present invention has the advantages that the filtering member can be fixedly mounted to the ventilating fan body in a simple structure manner without using fasteners such as screws, so as to facilitate the operation and save the working time. Moreover, the filtering member is not blown off to fall off when the ventilating fan hood is removed. In addition, the mounting of the filtering member in a reverse order is eliminated.

5 Claims, 6 Drawing Sheets

(58) Field of Classification Search
CPC ..... F24F 13/28; F02M 35/02416; F02M 35/02425
USPC ..... 454/158, 201, 207, 241, 242, 243, 244, 454/341–356
See application file for complete search history.

(56) References Cited

U.S. PATENT DOCUMENTS

| | | | | |
|---|---|---|---|---|
| 2,837,021 | A | 6/1958 | McLarty | |
| 3,288,508 | A * | 11/1966 | Maize | E05C 3/14 292/128 |
| 3,635,001 | A * | 1/1972 | Komroff et al. | 96/417 |
| 4,843,298 | A | 6/1989 | Brauch | |
| 6,149,698 | A | 11/2000 | Uehara | |
| 6,241,600 | B1 | 6/2001 | Uehara | |
| 6,435,962 | B1 | 8/2002 | Herron | |
| 6,453,972 | B1 | 9/2002 | Sher | |
| 7,641,125 | B2 | 1/2010 | Rimmer | |
| 8,371,913 | B1 | 2/2013 | Taylor | |
| 8,419,515 | B1 | 4/2013 | Dillon | |
| 9,033,684 | B2 | 5/2015 | Long | |
| 2004/0171345 | A1 | 9/2004 | Pesch | |
| 2006/0079171 | A1 | 4/2006 | Lu | |
| 2006/0243814 | A1 | 11/2006 | Rimmer | |
| 2007/0012192 | A1 * | 1/2007 | Pippel et al. | 96/417 |
| 2009/0149124 | A1 | 6/2009 | Stevenson | |
| 2014/0187139 | A1 | 7/2014 | Zhong | |

FOREIGN PATENT DOCUMENTS

| | | |
|---|---|---|
| CN | 101430129 | 5/2009 |
| CN | 101446432 | 6/2009 |
| CN | 101796348 | 8/2010 |
| JP | 2000346411 | 12/2000 |
| JP | 2001336795 | 12/2001 |
| JP | 2005083587 | 3/2005 |
| JP | 2006162138 | 6/2006 |
| JP | 4391168 | 12/2009 |

OTHER PUBLICATIONS

Entire patent prosecution history of U.S. Appl. No. 14/006,230, filed Nov. 18, 2013, entitled, "Ventilation Device."
International Search Report for International Application No. PCT/CN2012/077082, dated Sep. 20, 2012.
Machine Translation of the Publication No. JP 2005-83587.
Raw Machine Translation of the Japanese Publication JP 2001-336795A, Makino et al., Ventilator, Dec. 2001.
Written Opinion for International Application No. PCT/CN2012/077082, dated Sep. 7, 2012.
Non Final Office Action mailed Apr. 22, 2016 for U.S. Appl. No. 14/006,230.
Notice of Allowance dated Sep. 16, 2016 for U.S. Appl. No. 14/006,230, 10 pages.

* cited by examiner

VENTILATING FAN

CROSS-REFERENCE TO RELATED APPLICATION

This application claims the benefit of Chinese Patent Application No. 201120482626.2 filed on Nov. 28, 2011 in the State Intellectual Property Office of China, the disclosure of which is incorporated herein by reference.

BACKGROUND OF THE INVENTION

Field of the Invention

The present invention relates to a ventilating fan.

Description of the Related Art

As shown in FIG. 1, a conventional ventilating fan 1 is provided. The ventilating fan 1 is mounted on a wall of an indoor side of a wind path therethrough from the indoor side to an outdoor side. The ventilating fan 1 comprises a ventilating fan hood 3, a filtering member 4, a ventilating fan body 5, and a ventilating fan mounting member 6.

The ventilating fan hood 3 is mounted on the ventilating fan body 5, and the filtering member 4 is provided between the ventilating fan hood 3 and the ventilating fan body 5. While the ventilating fan hood 3 is mounted on the ventilating fan body 5, the filtering member 4 is fixedly mounted by being sandwiched between the ventilating fan hood 3 and the ventilating fan body 5, and the ventilating fan body 5 is mounted on the ventilating fan mounting member 6.

With the operation of this ventilating fan, air exchange is performed by sucking the fresh air from the outdoor to the indoor.

With regard to the structure of the ventilating fan 1 in the prior art, since the filtering member 4 is fixedly mounted by being sandwiched between the ventilating fan hood 3 and the ventilating fan body 5 instead of by being fixed to the ventilating fan body 5, the filtering member 4 would be likely to be blown off to fall off when the ventilating fan hood 3 is removed, for maintenance of the ventilating fan body 5.

In addition, the filtering member 4 should be remounted onto the ventilating fan body 5 after maintenance of the latter. There is a possibility that the filtering member 4 is remounted onto the ventilating fan body 5 in a reverse order. However, the filtering member 4 has a unique normal mounting order. If it is remounted in a reverse order, the filtering member's service life is greatly reduced due to its structure.

SUMMARY OF THE INVENTION

The present invention has been made to overcome or alleviate at least one of the above-mentioned problems and drawbacks existing in the prior art.

Accordingly, it is at least an object of the present invention to provide a ventilating fan, which has a filtering member that is stably mounted.

In order to achieve at least one of the above-mentioned objects, the present invention provides a ventilating fan mounted on a wall of an indoor side of a wind path therethrough from the indoor side to an outdoor side, the ventilating fan comprising a ventilating fan hood, a filtering member, a ventilating fan body, and a ventilating fan mounting member; wherein the filtering member is integrally formed by a frame provided with an engagement that is engaged with the ventilating fan body and a filtering screen located within the frame.

In one aspect, the filtering screen is provided along the ventilating fan hood.

In one aspect, the engagement comprises: a protruding sheet, provided at one side of the frame of the filtering member and formed by extending the frame of the filtering member in a horizontal direction; a resilient fixing section, provided at the opposite other side of the frame of the filtering member, formed by extending the frame of the filtering member in a vertical direction, and, the resilient fixing section comprising a hook portion and a resilient portion; and a first opening, formed at one side of the ventilating fan body and being engaged with the protruding sheet; and, a second opening being engaged with the fixing section and a projection, formed at the other side, opposing to the first opening, of the ventilating fan body.

In one aspect, a handle is provided at the frame of the filtering member, at the same side with the resilient fixing section, and is formed by extending the frame of the filtering member in the horizontal direction, and, the handle is further provided with a nonskid concavo-convex structure.

In one aspect, when a pressure force is exerted on the fixing section, the fixing section is depressed to be engaged into the second opening while the hook portion gets in contact with the projection; and, when the pressure force exerted on the fixing section is released, the depressed fixing section is restored to the original state while the hook portion is engaged with the projection.

In one aspect, a cross resin reinforced rib is provided inside the filtering screen, and, a crossing point of the resin reinforced rib is aligned with a center of a motor.

As apparent form the above, the ventilating fan according to the present invention at least has the following advantages and benefits: the filtering member can be fixedly mounted to the ventilating fan body in a simple structure manner without involving fasteners such as screws, so as to facilitate the operation and save the working time. Moreover, the filtering member is not blown off to fall off when the ventilating fan hood is removed. In addition, the mounting of the filtering member in a reverse order is eliminated.

BRIEF DESCRIPTION OF THE DRAWINGS

The present invention may be understood and its features made apparent to those skilled in the art by referencing the accompanying drawings.

DETAILED DESCRIPTION OF PREFERRED EMBODIMENTS OF THE INVENTION

Figure 1:
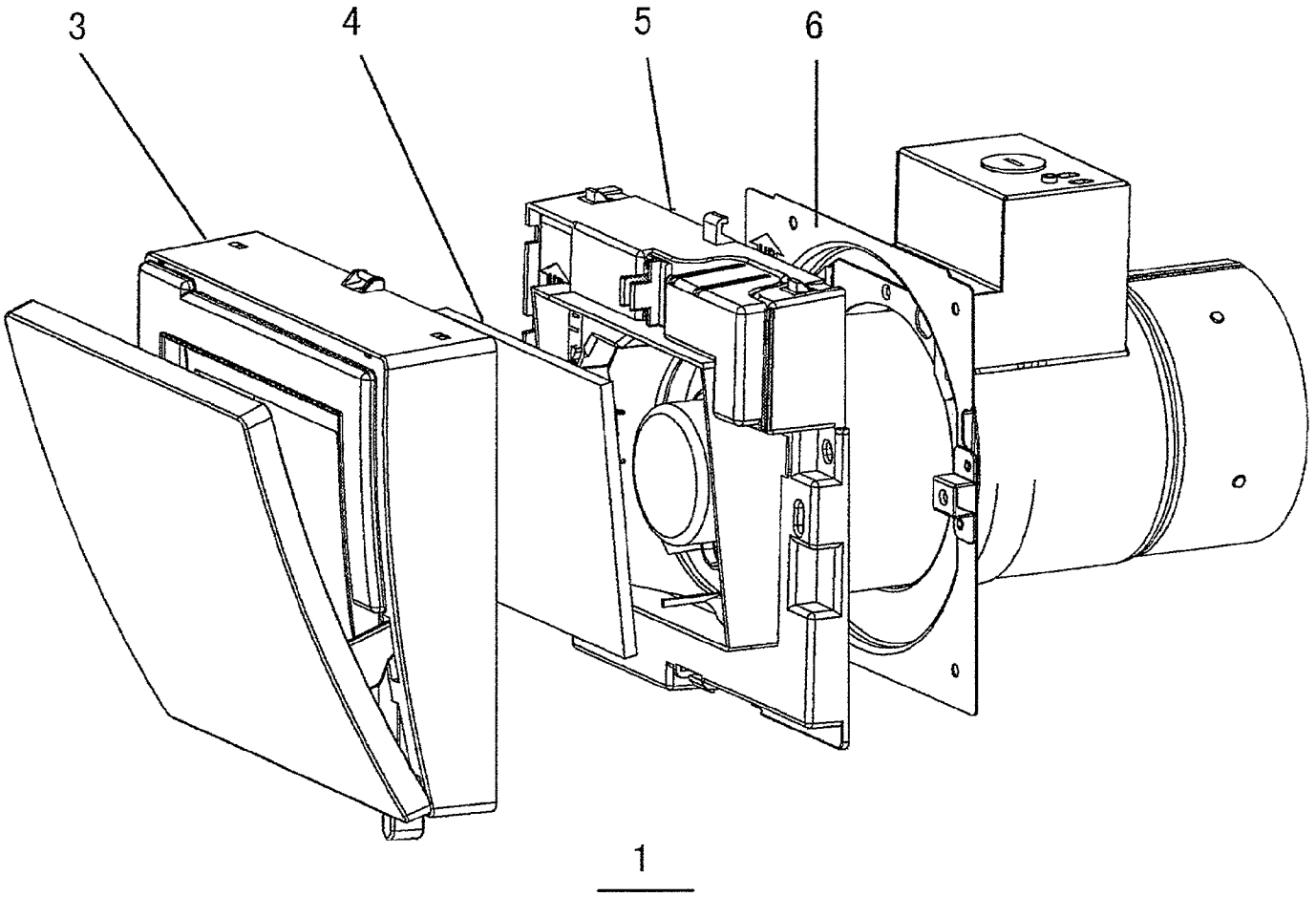
Fig. 1 PRIOR ART
FIG. 1 is a schematic view of a conventional ventilating fan in the prior art.

In the following description, numerous specific details are set forth to provide a more thorough description of the present invention. It will be apparent, however, to one skilled in the art, that the present invention may be practiced without these specific details. In other instances, well-known features have not been described in detail so as not to obscure the invention.

FIG. 2A is a schematic view of a ventilating fan according to the present invention. FIG. 3 is a schematic view of a filtering member, mounted on a ventilating fan body, according to the present invention.

As shown in Figures, there is a ventilating fan 10 mounted on a wall of an indoor side of a wind path therethrough from the indoor side to an outdoor side. The ventilating fan 10 comprises a ventilating fan hood 20, a filtering member 30, a ventilating fan body 40 and a ventilating fan mounting member 50. The filtering member 30 is integrally formed by a frame 32 provided with an engagement that is engaged with the ventilating fan body 40 and a filtering screen 31 located within the frame 32. The filtering screen 31 and the frame 32 may be made of resin, or other flexible materials. The ventilating fan hood 20 is covered by the filtering screen 31 such that wind from the wind path passes through the filtering screen 31, to achieve a maximum filtering area of the filtering screen 31 and reduce resistance for passing of the polluted air, so as to improve the filtering effect.

Figure 4:
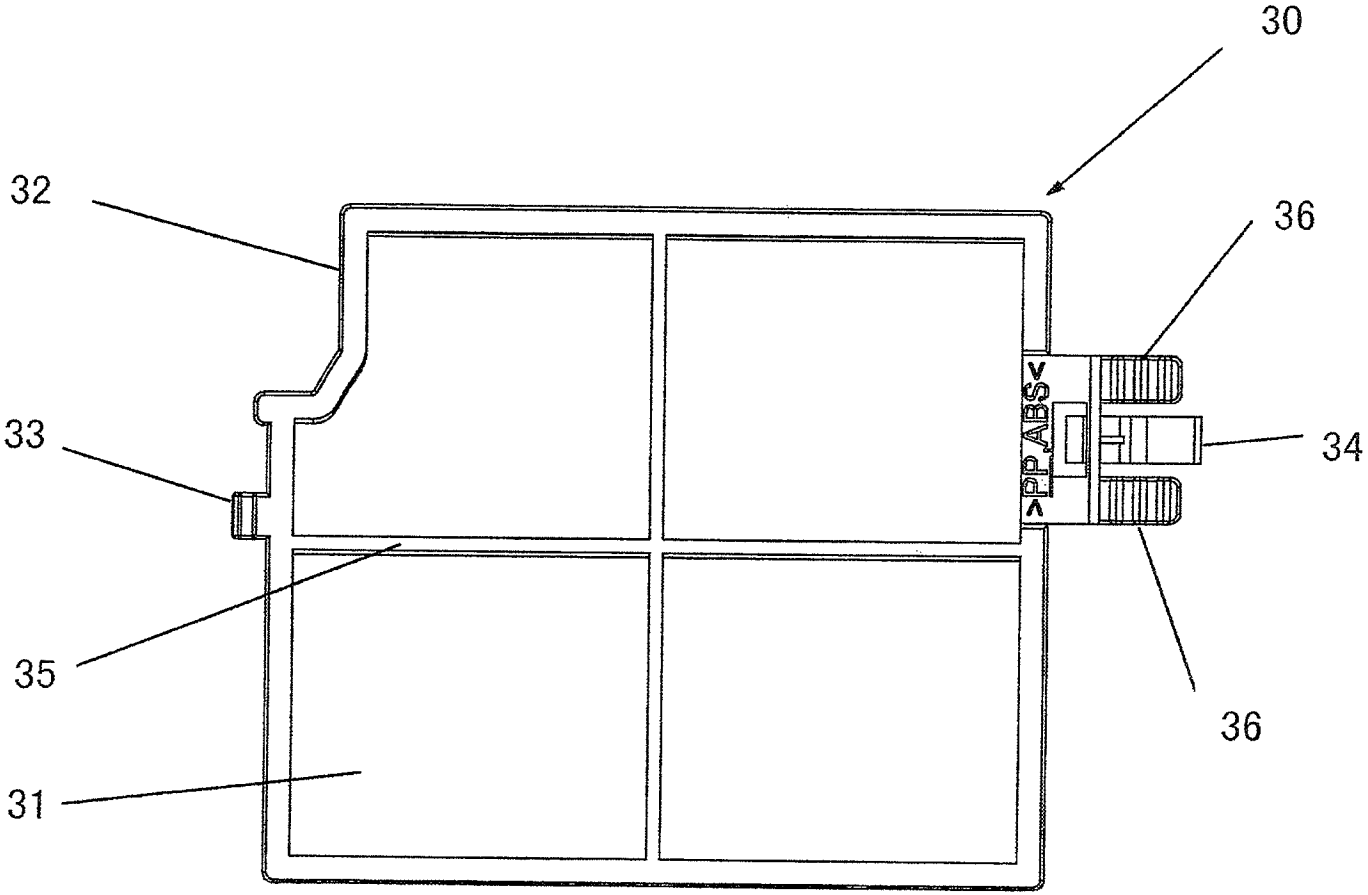
FIG. 4 is a front schematic view of the filtering member according to the present invention.
Figure 5:
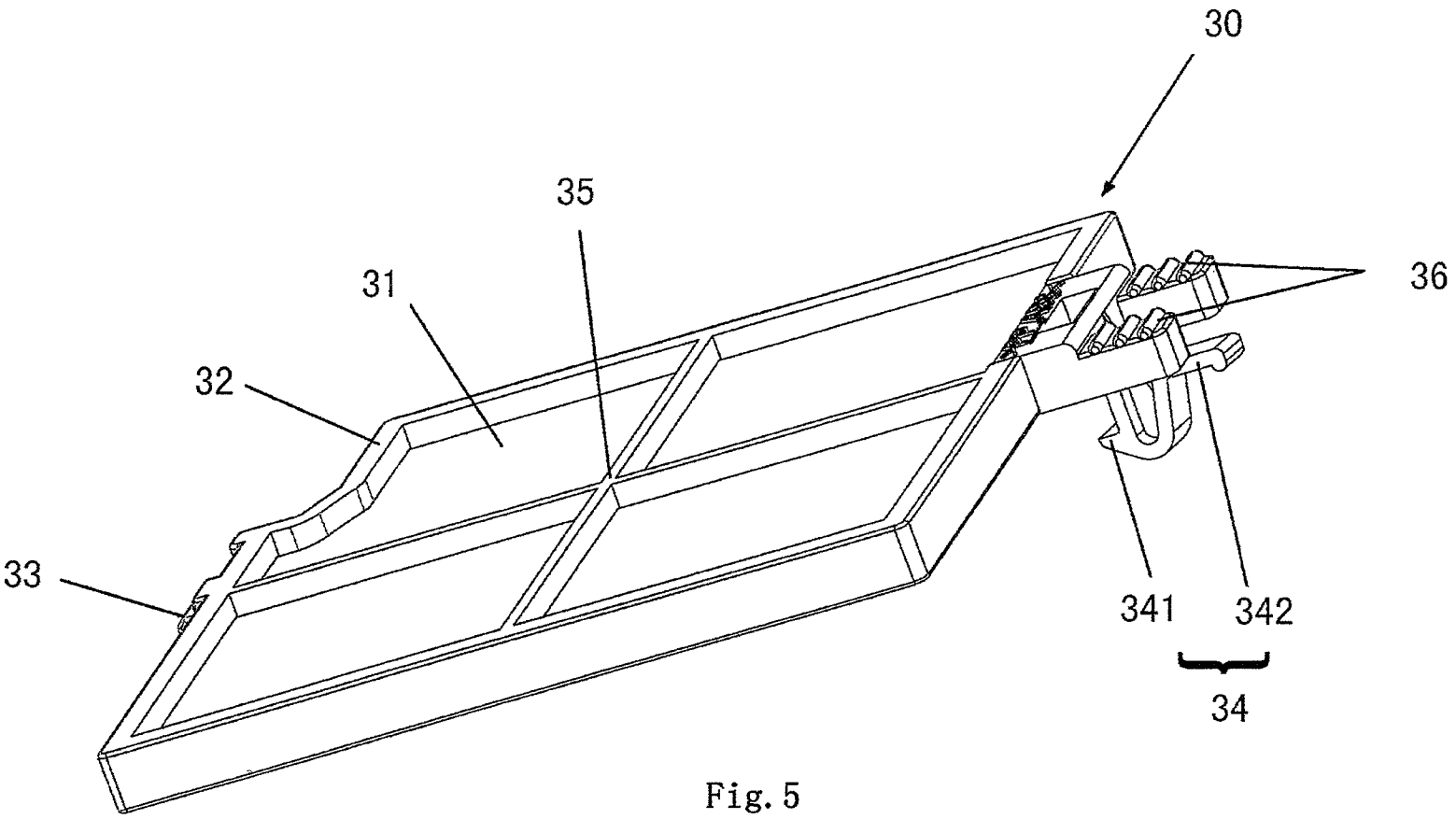
FIG. 5 is a schematically perspective view of the filtering member according to the present invention.
Figure 6:
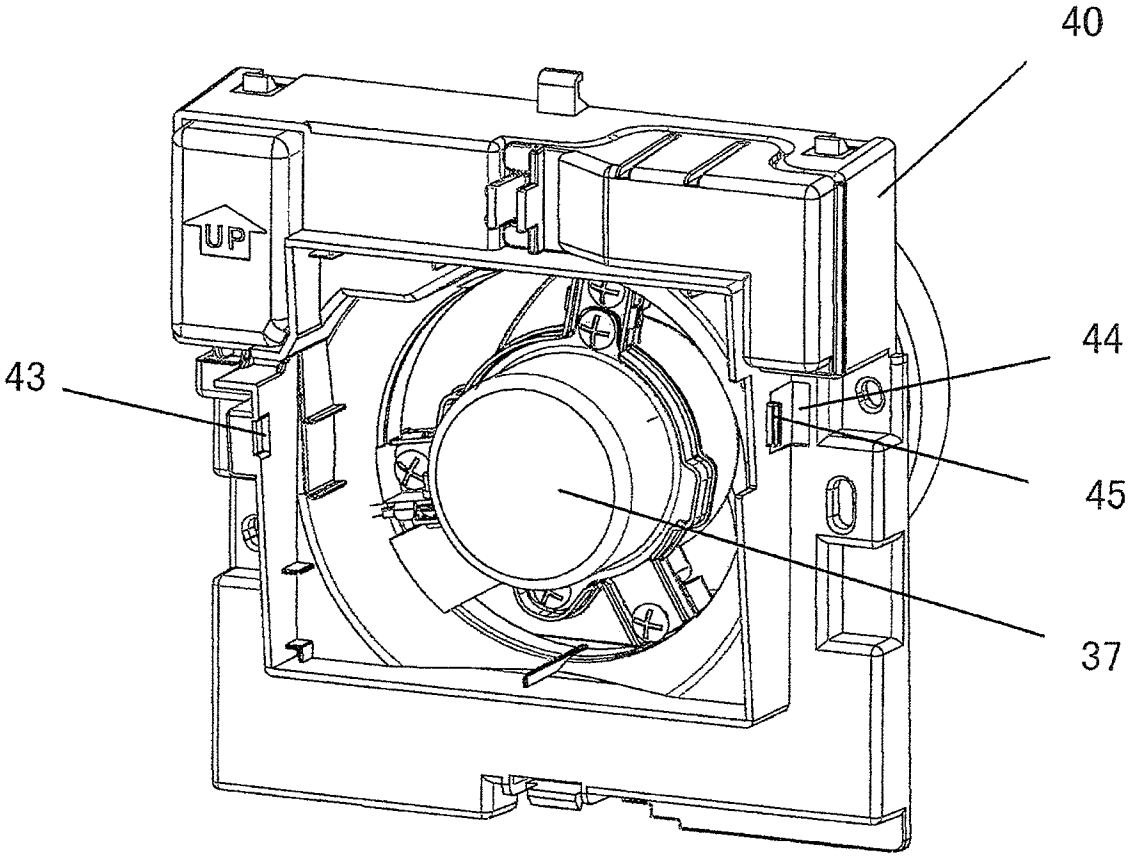
FIG. 6 is a schematic view of a ventilating fan body according to the present invention.

FIG. 4 is a front schematic view of the filtering member, FIG. 5 is a schematically perspective view of the filtering member, and, FIG. 6 is a schematic view of a ventilating fan body.

Figure 2:
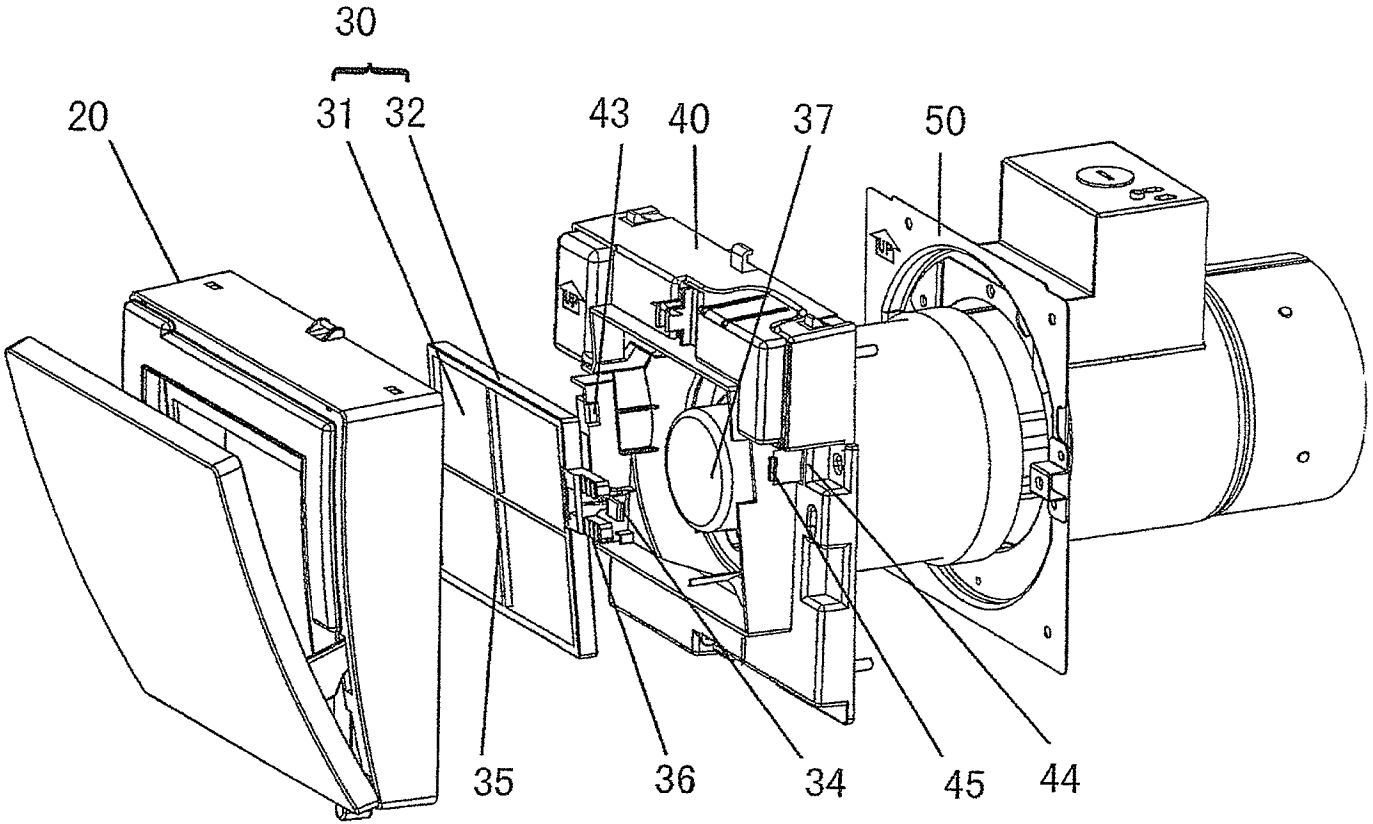
FIG. 2 is a schematic view of the ventilating fan according to the present invention.
Figure 3:
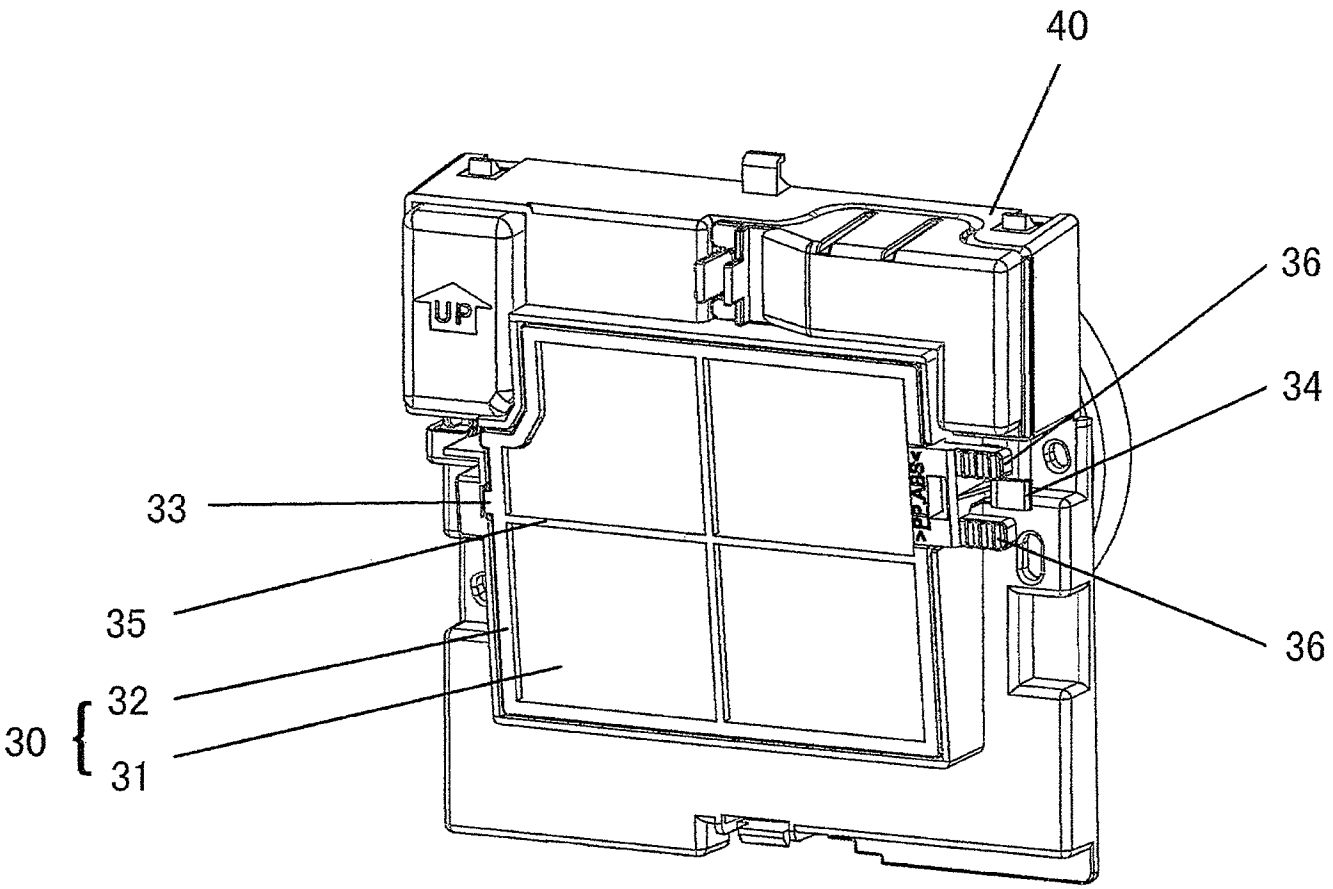
FIG. 3 is a schematic view of a filtering member, mounted on a body of the ventilating fan, according to the present invention.

As shown in Figures, the engagement comprises: a protruding sheet 33, provided at one side of the frame 32 of the filtering member 30 and formed by extending the frame 32 of the filtering member 30 in a horizontal direction; a resilient fixing section 34, provided at the opposite other side of the frame 32 of the filtering member 30, formed by extending the frame 32 of the filtering member 30 in a vertical direction (i.e., formed by extending the filtering member 30 toward the ventilating fan body 40, as shown in FIG. 2). The resilient fixing section 34 comprises a hook portion 341 and a resilient portion 342; and a first opening 43 (as shown in FIG. 2), formed at one side of the ventilating fan body 40 and being engaged with the protruding sheet 33; and, a second opening 44 being engaged with the fixing section 34 and a projection 45, formed at the other side, opposing to the first opening 43, of the ventilating fan body 40.

With the above-mentioned configuration, in order to secure the filtering member 30 onto the ventilating fan body 40, first of all, to engage the protruding sheet 33 provided at one side of the frame 32 of the filtering member 30 into the first opening 43 of the ventilating fan body 40; then, to press the fixing section 34 toward the ventilating fan body 40, such that, due to resilient performance of the fixing section 34, when a pressure force is exerted on the fixing section 32, the fixing section 32 is depressed to be engaged into the second opening 44 while the hook portion 341 gets in contact with the projection 45; next, when the pressure force exerted on the fixing section 32 is released, the depressed fixing section 34 is restored to the original state while the hook portion 341 is engaged with the projection 45, that is, the filtering member 30 is finally secured onto the ventilating fan body 40. Accordingly, the filtering member 30 can be fixedly mounted to the ventilating fan body 40 in a simple structure manner without using fasteners such as screws.

Further, once, for maintenance of the ventilating fan body 40, the ventilating fan hood 20 is removed by user, the filtering member 30 would not be blown off to fall off since the engagement of the filtering member 30 and the ventilating fan body 40 are in an engagement relationship, that is, the filtering member 30 is secured on the ventilating fan body 40.

Furthermore, the engagement, which is ready to be engaged with the corresponding one of the ventilating fan body 40, is integrally formed with the filtering member 30. After maintenance of the ventilating fan body 40, the filtering member 30 is remounted to the ventilating fan body 40 in a normal order, because the frame 32 of the filtering member 30 has a shape which is conformed with that of the ventilating fan body 40, and the engagement of the filtering member 30 corresponds with that of the ventilating fan body 40. Accordingly, the mounting of the filtering member 30 in a reverse order is eliminated.

Again, referring to FIG. 3 and FIG. 4, a handle 36 is provided at the frame 32 of the filtering member 30, at the same side with the resilient fixing section 34, and the handle 36 is formed by extending the frame 32 of the filtering member 30 in the horizontal direction, and, the handle 36 is further provided with a nonskid concavo-convex structure. In order to remove the filtering member 30, for maintenance of the ventilating fan, the handle 36 provided at the opposite other side of the frame 32 of the filtering member 30 is pressed down by the user, such that the handle 36 is ready to be mounted onto/detached from the ventilating fan body 40. Accordingly, the filtering member 30 can be simply detached from the ventilating fan body 40. After maintenance of the ventilating fan body 40, the filtering member 30 can be simply mounted to the ventilating fan body 40 by the handle 36. Further, since a nonskid concavo-convex structure is provided on the handle 36, the detachment and the mounting of the filtering member 30 are much easier due to full contact among the users' fingers and the concavo-convex structure.

In addition, a cross resin reinforced rib 35 is provided inside the filtering screen 31, and, a crossing point of the resin reinforced rib 35 is aligned with a center of a motor 37. Accordingly, the wind in the wind path passes, around the motor, to the ventilating fan hood 20. Since the wind in the wind path does not pass through a center of the resin reinforced rib 35, reduction of the pressure loss is prevented and the wind may pass through in an unhindered manner.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A ventilating fan comprising a ventilating fan hood, a filtering member, a ventilating fan body and a ventilating fan mounting member;

wherein said filtering member is integrally formed by a frame provided with an engagement device that is engaged with said ventilating fan body and a filtering screen located within said frame; wherein said engagement device comprises:

(i) a resilient protruding sheet at one side of the frame of said filtering member, said resilient protruding sheet extending from the frame in a horizontal direction;

(ii) a resilient fixing section at the opposite other side of the frame of said filtering member with respect to the resilient protruding sheet, said resilient fixing section extending from the frame of said filtering member in a vertical direction, and, the resilient fixing section comprising a hook portion and a resilient portion;

(iii) a first opening, formed at one side of said ventilating fan body and being engaged with said resilient protruding sheet; and (iv) a second opening formed at another side of said ventilating fan body opposing said first opening, the hook portion of the resilient fixing section being engaged with the second opening and a projection formed on the ventilating fan body; and wherein the ventilating fan further comprises a handle provided on the same side of the frame as the resilient fixing section, wherein the handle includes two projections that extend from the frame of said filtering member in the horizontal direction, and the resilient fixing section is positioned at a location between the projections, wherein the projections and the resilient fixing section are integrally formed as a single piece with the frame, and wherein the hook portion of the resilient fixing section extends toward the second opening and the resilient portion of the resilient fixing section extends away from the second opening, the resilient portion extending from the frame at a location between the two projections for grasping by a user to disengage the hook portion from the second opening and the projection formed on the ventilating body.

2. The ventilating fan according to claim 1, wherein said filtering screen is provided along said ventilating fan hood.

3. The ventilating fan according to claim 1, wherein said handle includes a nonskid concavo-convex structure.

4. The ventilating fan according to claim 1, wherein when a pressure force is exerted on said fixing section, said fixing section is depressed to be engaged into said second opening while said hook portion contacts said projection; and, when the pressure force exerted on said fixing section is released, said depressed fixing section is restored to an original state while said hook portion is engaged with said projection.

5. The ventilating fan according to claim 1, further comprising a cross resin reinforced rib inside said filtering screen, and, wherein a crossing point of said resin reinforced rib is aligned with a center of a motor.

* * * * *